US006244968B1

(12) United States Patent
Arie

(10) Patent No.: US 6,244,968 B1
(45) Date of Patent: Jun. 12, 2001

(54) ELEVATED WOODEN RACETRACK FOR GO-KARTS AND ASSOCIATED METHODS

(76) Inventor: John Arie, 5551 Del Verde Way, Oviedo, FL (US) 32819-8505

( * ) Notice: Subject to any disclaimer, the term of this patent is extended or adjusted under 35 U.S.C. 154(b) by 0 days.

(21) Appl. No.: 09/383,771

(22) Filed: Aug. 26, 1999

(51) Int. Cl.[7] ..... A63K 1/00
(52) U.S. Cl. ..... 472/85; 472/88
(58) Field of Search ..... 472/85, 88, 89, 472/90; 404/1, 46; 104/60

(56) References Cited

U.S. PATENT DOCUMENTS

| | | | | |
|---|---|---|---|---|
| 419,860 | * | 1/1890 | Libbey | 472/43 |
| 798,979 | | 9/1905 | Reckweg . | |
| 809,588 | | 1/1906 | Thomas et al. . | |
| 872,253 | * | 11/1907 | Riehl | 472/43 |
| 953,724 | | 4/1910 | Kannel . | |
| 1,025,456 | | 5/1912 | Curran . | |
| 1,228,011 | | 5/1917 | Fisher . | |
| 1,668,249 | | 5/1928 | Rich . | |
| 1,713,793 | * | 5/1929 | Traver | 472/43 |
| 2,254,482 | * | 9/1941 | Heller | 472/89 |
| 2,387,859 | * | 10/1945 | Schmidt | 104/60 |
| 3,107,438 | | 10/1963 | Church et al. . | |
| 3,266,800 | * | 8/1966 | Yee | 472/89 |
| 3,810,706 | | 5/1974 | Grimm et al. . | |
| 4,964,837 | | 10/1990 | Collier . | |
| 5,100,155 | | 3/1992 | Lamanna Egidio . | |
| 5,195,920 | | 3/1993 | Collier . | |
| 5,635,903 | | 6/1997 | Koike et al. . | |
| 5,645,368 | | 7/1997 | Yunick . | |
| 5,660,595 | | 8/1997 | Ferro, Jr. et al. . | |
| 5,754,094 | | 5/1998 | Frushour . | |
| 5,782,186 | | 7/1998 | McTaggart . | |
| 5,800,272 | | 9/1998 | Pons . | |

* cited by examiner

*Primary Examiner*—Kien T. Nguyen
(74) *Attorney, Agent, or Firm*—Allen, Dyer, Doppelt, Milbrath & Gilchrist, P.A.

(57) ABSTRACT

An apparatus and methods for a racetrack for operating go-karts and similar motorized amusement vehicles thereon. The racetrack includes a wooden racetrack portion supported on a frame having a plurality of vertical support posts connected to a plurality of support members positioned underlying a wooden racetrack surface, thereby providing elevation above ground and structural support. The wooden racetrack surface includes a first and second outer periphery, and extends along a plurality of tiers elevated above ground level, forming a multi-level racetrack surface. In addition, the wooden racetrack surface includes a plurality of banked curves built from wooden slats positioned vertically on edge, each wooden slat abuttingly adjoining at least one other wooden slat of the plurality, bent into shape and positioned at a predetermined angle of inclination from an inside curve periphery to an outside curve periphery, thereby forming an especially smooth banked curve. The plurality of banked curves may be joined with straightaway sections of racetrack to create turns, ovals, figure eights, multi-level spirals, or any other desired shape. An associated method of producing revenue from land having a stormwater retention basin thereon includes operating a go-kart amusement ride erected above a stormwater retention at a sufficient elevation such that the stormwater retention basin operates substantially within design characteristics.

22 Claims, 5 Drawing Sheets

40
22

10
12
40
12
22

ELEVATED WOODEN RACETRACK FOR GO-KARTS AND ASSOCIATED METHODS

FIELD OF THE INVENTION

The present invention relates to the field of racetracks for go-karts and, more particularly, to an elevated racetrack which may be erected over a parcel of land having a stormwater retention basin thereon.

BACKGROUND OF THE INVENTION

Go-karts and similar motorized amusement vehicles have been popular for many years. Driving a go-kart on a suitably proportioned racetrack is a fun-filled experience for the entire family, young and old. Racetracks for go-karts have been part of the amusement park industry practically since commercially available go-karts appeared on the market. Most go-kart tracks are asphalt or concrete racetracks built at ground level, much as roads for regular vehicles.

Because of the technical difficulty and expense involved in building an elevated go-kart racetrack, fewer of these tracks have been built. In addition, building an elevated racetrack using conventional techniques, such as concrete or asphalt, greatly increases the expense of construction. Therefore, builders have turned to wood as a suitable construction material for elevated go-kart racetracks. Previous to the present invention, however, elevated go-kart racetrack construction produced tracks essentially resembling elevated boardwalks, whose surface was uneven, resulting in a very bumpy ride and causing increased frequency of breakdowns in the vehicles. Additionally, building smooth banked curves has been very difficult and extremely labor intensive.

SUMMARY OF THE INVENTION

With the foregoing in mind, the present invention advantageously provides a go-kart racetrack including an elevated wooden racetrack surface supported by a structural frame anchored to the ground below. The wooden racetrack surface includes a plurality of floor boards, has a first and second outer periphery defining the outer edges of the racetrack, and extends along a plurality of tiers elevated above ground level. The wooden racetrack surface also includes a plurality of banked curves formed from a plurality of wooden slats positioned vertically on edge and abuttingly adjoining at least one other wooden slat of said plurality. In constructing the banked curves the plurality of wooden slats is positioned bent into shape and at a predetermined angle of inclination from the inside curve periphery to the outside curve periphery, thereby to define the banked curve. The wooden racetrack surface is supported on a racetrack support frame having a plurality of vertical support posts positioned anchored on suitable land and connected to a plurality of support beams and support joists and stringers acting as braces positioned abuttingly underlying and connected directly or indirectly to the wooden racetrack surface, thereby to provide elevation above ground and structural support.

In addition, the invention includes a method of producing revenue from land having thereon a stormwater retention basin by operating the motorized amusement vehicle ride over the stormwater retention basin. The method includes the steps of providing at least one motorized amusement vehicle positioned on a racetrack erected over the stormwater retention basin, the racetrack sufficiently elevated above ground level such that the stormwater retention basin operates substantially within design characteristics, and allowing drivers to operate the motorized amusement vehicle for a fee, thereby producing revenue.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime notation when used indicates similar elements in alternative embodiments.

Figures 3, 4:
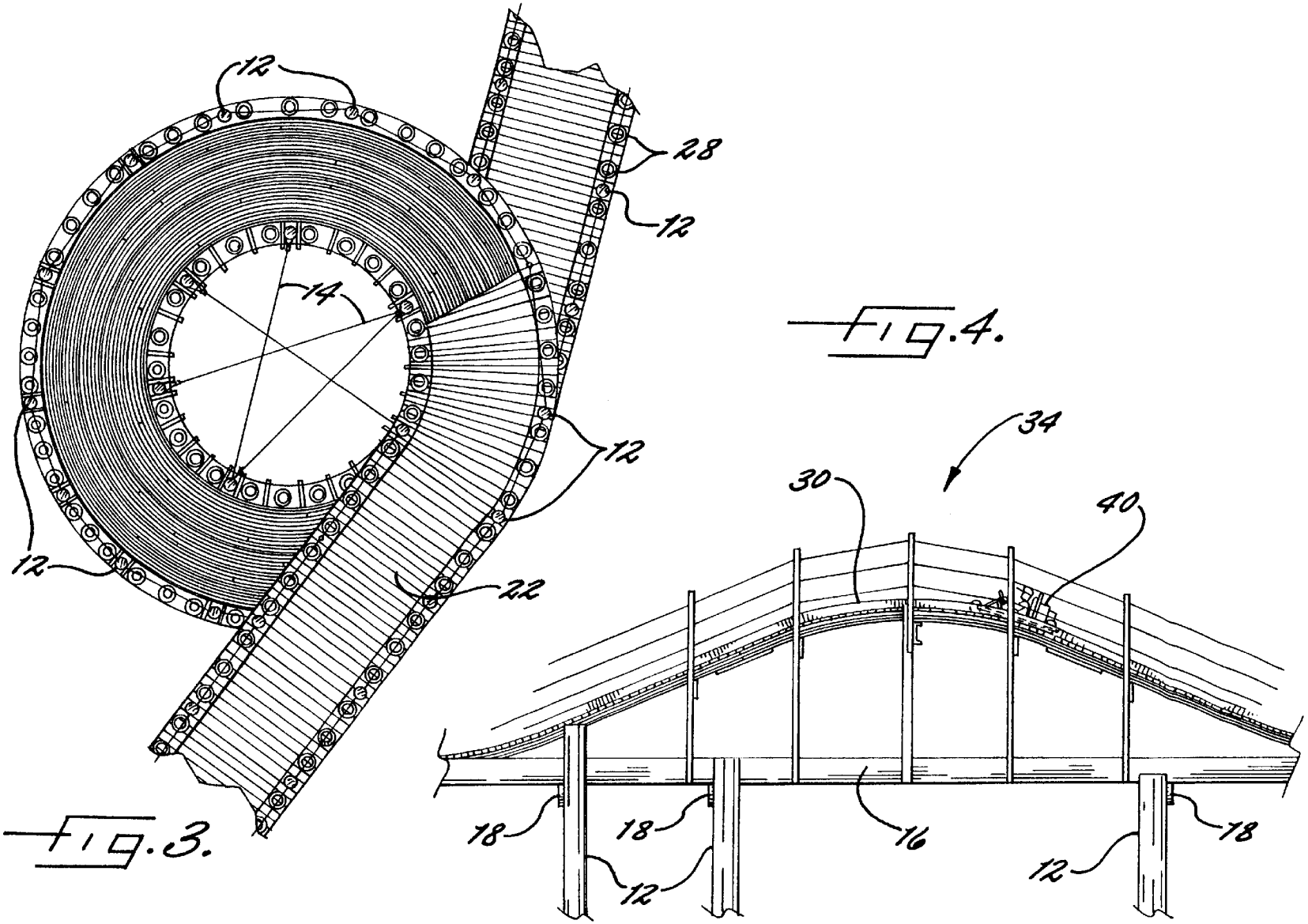
FIG. 3 shows a top plan view of a single-level spiral curve.
FIG. 4 is a side elevation showing an arched bridge section of the elevated wooden track.
Figure 5:
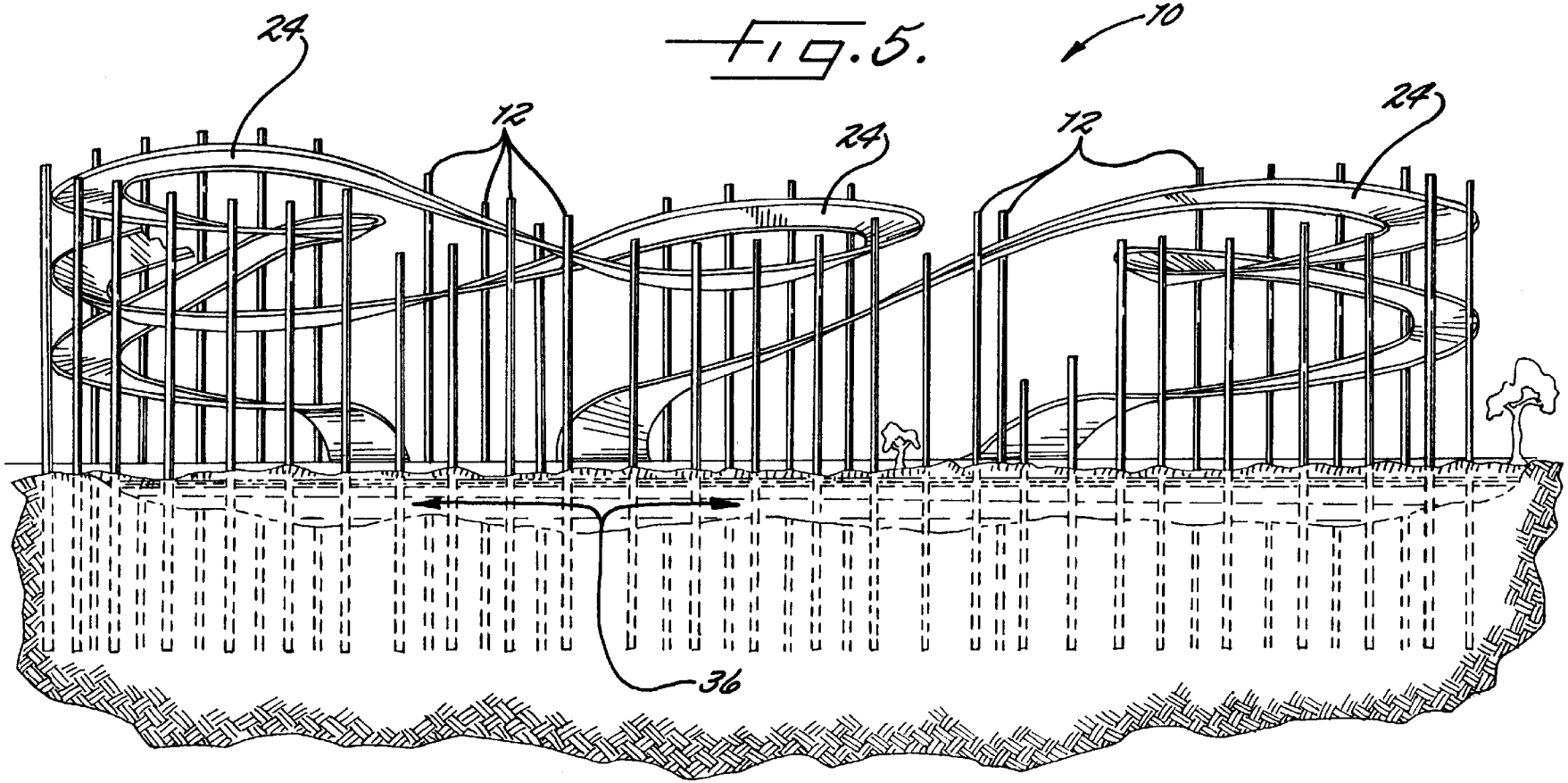
FIG. 5 is an overall side elevation illustrating the elevated wooden racetrack and its support posts.
Figures 6, 7:
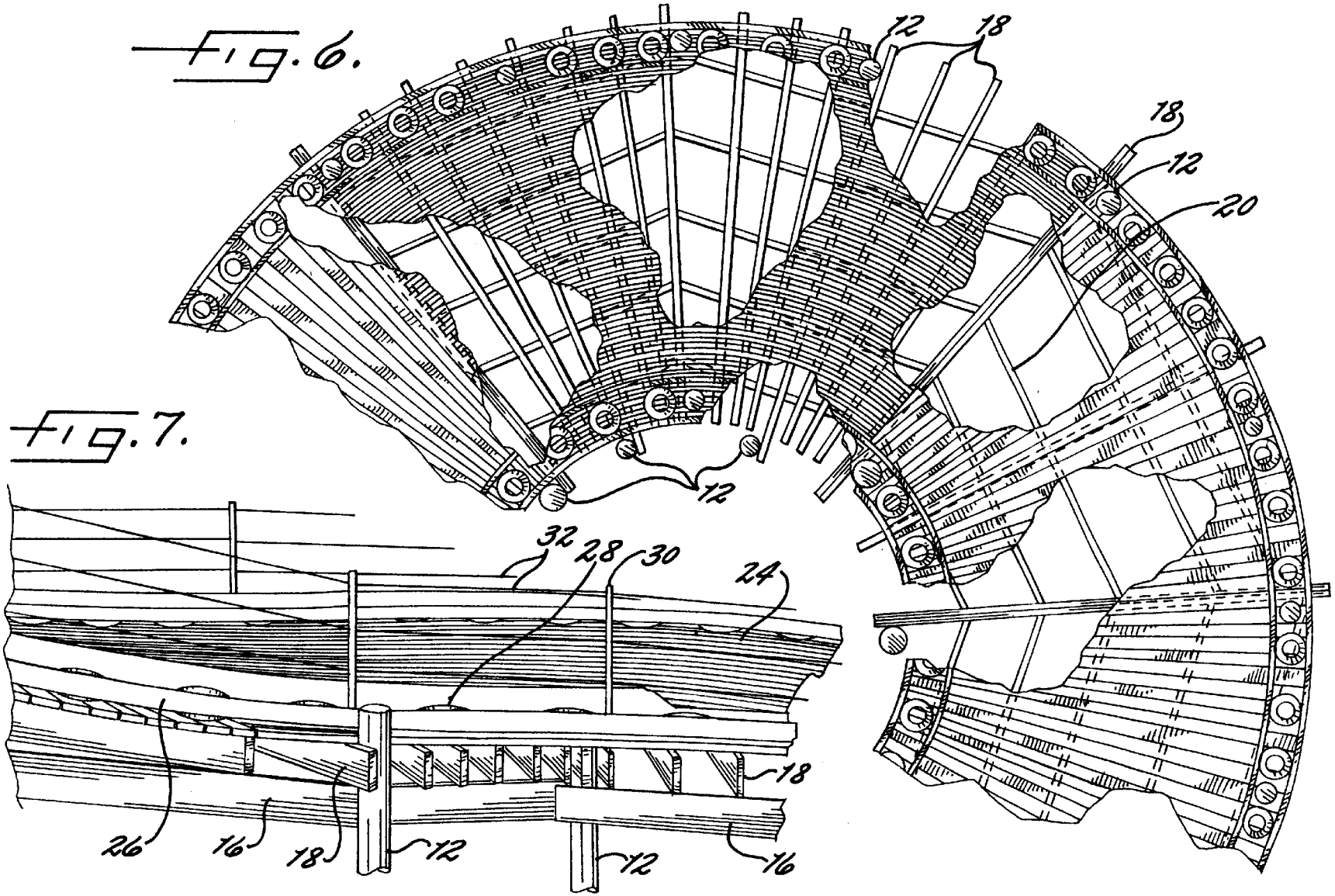
FIG. 6 is a cutaway view showing construction detail showing two types of curve construction.
FIG. 7 is a side perspective view showing construction detail of the elevated wooden racetrack.

FIGS. 1 through 7 illustrate a racetrack for operating motorized amusement vehicles thereon. The racetrack includes an elevated wooden racetrack 10 positioned on a support frame having a plurality of vertical support posts 12, best shown in FIGS. 1 and 5. As used herein and known to those skilled in the art, the terms for the various members included in the support frame are intended to generally have the following meanings. Vertical support posts 12, shown in FIGS. 1, 4, 5, and 7, are vertically oriented support members having one end sunk into the ground and the other end at a sufficient height to meet the design and engineering requirements for providing support for the elevated track 10. Beam supports 16 are substantially horizontal support members connected to posts 12 and serving to sustain the various beams. Beam supports 16 are preferably boards having a nominal size of two-by-twelve (2×12). Beams are substantially horizontal support members running generally perpendicular to the track, and connected to posts 12 and/or to beam supports 16. Beams 18 may be subdivided into two categories, depending on how they are connected in the support frame. Primary beams are connected to at least two posts, generally positioned directly opposite each other along the track, as seen in FIG. 6. Primary beams are preferably made by joining a plurality of boards to form a laminated beam, also as seen in FIG. 6. Secondary beams are connected to beam support members 16, or to a post 12 and a beam support member 16. Beams are generally members having a nominal size of two-by-twelve (2×12). Joists 20 are generally horizontal support members running substantially parallel to the track and abuttingly connected to beams, preferably through the use of joist hangers, as known in the art. Stringers are generally horizontal support members running parallel to the track but which, unlike joists 20, are connected to beams by being positioned on top of the beams, usually standing on edge. Joists 20 and stringers are substantially equivalent support members and may be used essentially interchangeably. Joists and stringers are generally either two-by-six (2×6) or two-by-twelve (2×12).

The posts 12, in a preferred embodiment, are substantially similar to wooden telephone poles. The vertical support posts 12 may be stabilized by any method known to those skilled in the art, and are preferably sunk into the ground to a depth sufficient to provide sufficient stability for the support frame. The posts 12 may be also further stabilized by being connected to the ground or to each other by supporting cables 14, as shown in FIG. 3. As known to those skilled in the art, the posts may be further stabilized by being set in concrete, rock gravel, and the like. The vertical support posts 12 are connected to a plurality of support members, as variously shown in FIGS. 4, 6 and 7.

The support beams 18 and support joists 20 may be positioned abuttingly underlying and directly or indirectly connected to the wooden racetrack surface 22, as best shown in FIG. 7, thereby providing elevation above ground and structural support for the wooden racetrack surface 22. The whole assembly of vertical support posts 12, beams 18, joists 20 and stringers forms an interconnected network of support members which collectively make up the racetrack support frame.

Figures 1, 2:
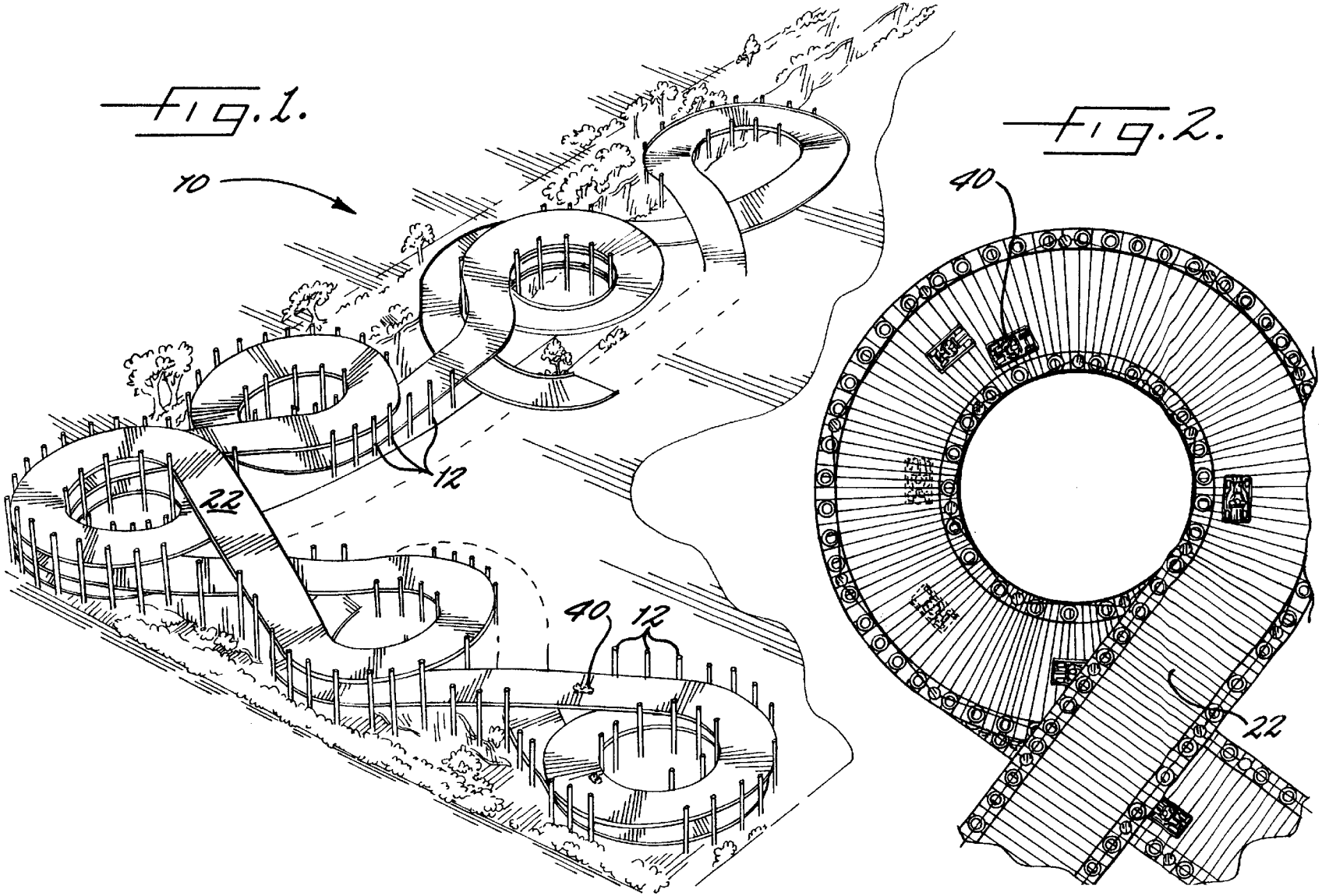
FIG. 1 is an overall perspective view of the elevated wooden racetrack according to an embodiment of the present invention.
FIG. 2 is a top plan view of a three-level spiral curve built with conventional construction methods.

The racetrack includes a wooden racetrack surface 22, best seen in FIGS. 2, 3 and 6, connected to and supported by the racetrack support frame. The wooden racetrack surface 22 has a first and second outer periphery, forming the edges of the track surface, and extends along a plurality of tiers elevated above ground level, creating the multi-level racetrack surface 22 shown in FIGS. 1 and 5.

Figure 8:
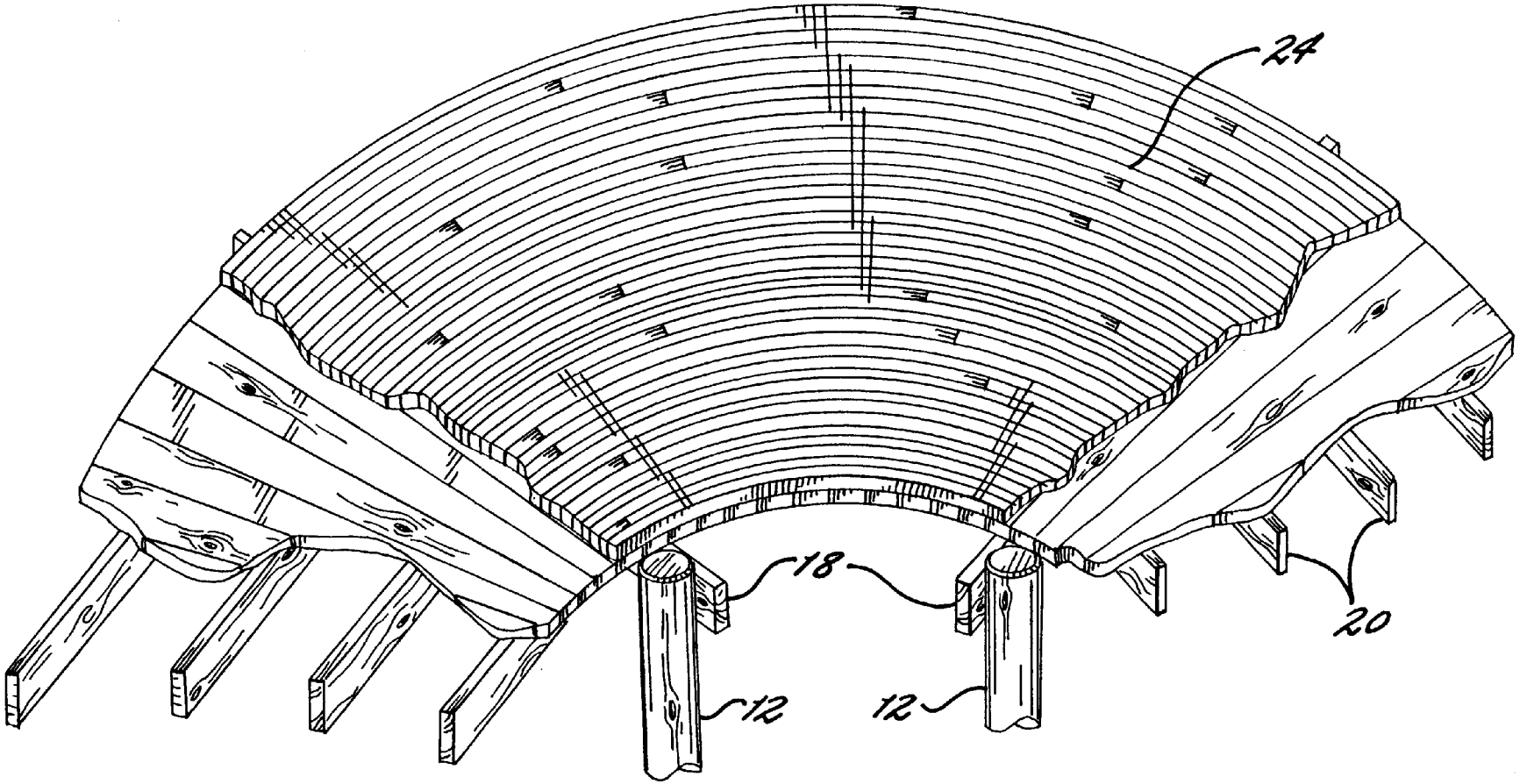
FIG. 8 illustrates a banked curve constructed of on edge wooden slats overlying a layer of wood planks.

In addition, the wooden racetrack surface 22 includes a plurality of banked curves 24, at times forming spirals, as illustrated in FIG. 5. Each banked curve 24 defines at least part of the circumference of an imaginary circle having a predetermined center. The first outer periphery of the banked curve 24 is positioned toward the center of the imaginary circle so as to define an inside curve periphery. The second outer periphery of each banked curve 24 is positioned toward the circumference of the imaginary circle so as to define an outside curve periphery for the curve. Each banked curve 24 is formed by a plurality of wooden slats positioned vertically on edge and abuttingly adjoining at least one other wooden slat of the plurality, shown in FIGS. 3 and 6, producing a surface resembling that of a bowling alley. The on edge positioning of the wooden slats to form banked curves 24 is a novel approach to such construction. The on edge structure of the surface results in a very smooth banked curved surface which is a configuration very difficult to achieve with conventional curve construction where the surface boards are laid flat. Such conventional curve construction is illustrated in FIG. 2. The plurality of on edge wooden slats is positioned bent into shape and at a predetermined angle of inclination from the inside curve periphery to the outside curve periphery, thereby defining the banked curve 24. Each banked curve may be banked at a predetermined angle varying from approximately 10 to 35 degrees of inclination, depending on the design of the racetrack. In addition, the plurality of banked curves 24 may include at least one layer of wood positioned between the plurality of wooden slats and the plurality of support members, so as to provide an underlying, unifying structural foundation for the plurality of wooden slats, thereby adding great structural strength to the banked curves 24. The layer of wood may preferably be a laminated wood product such as plywood, or may simply be a conventional planked surface as shown in FIG. 8. This arrangement also allows for reconstruction of a conventionally built curve by overlaying an existing conventional curve with on edge wooden slats. The plurality of banked curves 24 may be combined with straightaway sections of racetrack to create turns, ovals, figure eights, multi-level spirals, or any other desired shape, as generally shown in FIG. 1.

Several further aspects of a preferred embodiment of the invention will now be described with reference to the accompanying figures. First, it will be apparent to those skilled in the art that a preferred wood for building the present invention is pressure treated timber or other weather resistant wood. The vertical support posts 12, in particular, must be resistant to deterioration brought about by ground contact, including wood destroying organisms such as termites. The motorized amusement vehicles are preferably go-karts 40 positioned to operate on the racetrack, as illustrated in FIGS. 2 and 4. The racetrack also preferably includes a shock absorbing guard rail 26 positioned along at least one outer periphery of the wooden racetrack surface 22, thereby to absorb the shock of an impact produced by one of the motorized amusement vehicles. The shock absorbing guard rail 26 may include tires 28 as a resilient, shock absorbing material, best shown in FIGS. 2, 3 and 6. In a preferred embodiment the tires 28 are old discarded tires from small aircraft, which can be obtained inexpensively, are particularly strong, and have a relatively small diameter, thus taking up less space along the edge of the racetrack surface 22. The tires 28 are provided with drainage holes drilled through whichever side of the tire will face down on the racetrack, thereby helping prevent accumulation of rain water within the tire cavity. The shock absorbing guard rail 26 may be low, resembling a curb as shown in FIGS. 6 and 7, or may be taller depending on preference or the characteristics of the particular racetrack. In addition, the racetrack preferably includes a safety fence 30 positioned along the first and second outer peripheries, or sides of the wooden racetrack surface 22. The safety fence 30 preferably includes a plurality of safety wires 32 connected to the vertical support posts 12 and positioned along the first and second outer peripheries of the wooden racetrack surface 22, thereby serving as a retaining safety fence 30 to prevent the motorized amusement vehicles from accidentally leaving the wooden racetrack surface 22. Such a safety fence 30 is best shown in side elevation in FIG. 7.

The racetrack surface 22 may have other topographical features to provide a variable terrain tending to promote amusement in the operator of the vehicle. For example, the wooden racetrack surface 22 may preferably include at least one arched bridge 34 section positioned to form an overpass above at least another portion of the wooden racetrack surface 22, a feature shown in FIG. 4. Vehicle operators passing the arched bridge 34 will experience an exhilarating sensation similar to that produced when cresting a hill on a highway, including the slight pull of gravity forces on the way up the hill and the sudden drop in gravity at reaching and passing the crest. A wooden arched bridge 34 is very difficult to build using conventional techniques to create a smooth and even transition up to the crest of the bridge and down thereafter. A feature of the invention particularly useful for construction of such bridges is a laminated support beam including a plurality of wooden boards connected to each other so as to form the laminated support beam. The laminated support beam is positioned connected to and underlying the wooden racetrack surface 22 creating the bridge, thereby providing very strong structural support. Advantageously, the plurality of wooden boards making up this laminated beam is staggered in position relative to each other, so as to create a support beam having a hump along one edge, thereby providing an underlying support structure for the arched bridge which allows the wooden racetrack surface 22 to be smooth and fully supported at the crest of the arch.

The present invention also includes an associated method preferably including three steps, as follows. First, providing a wooden racetrack surface 22 having a first and second outer periphery, the wooden racetrack surface 22 extending along a plurality of tiers elevated above ground level and having a plurality of banked curves 24, each banked curve defining at least part of a circumference of an imaginary circle having a predetermined center, the first outer periphery of the banked curve positioned toward the center so as to define an inside curve periphery, and the second outer periphery of the banked curve 24 positioned toward the circumference so as to define an outside curve periphery, each banked curve including a plurality of wooden slats positioned vertically on edge and abuttingly adjoining at least one other wooden slat of said plurality, the plurality of wooden slats positioned bent into shape and at a predetermined angle of inclination from the inside curve periphery to the outside curve periphery, thereby to define the banked curve 24, the wooden racetrack surface 22 useful for racing motorized amusement vehicles thereon. Secondly, providing a racetrack support frame including a plurality of vertical support posts 12 positioned anchored on suitable land and connected to a plurality of support beams 18 and support joists 20, the support beams 18 and support joists 20 positioned abuttingly underlying and connected to the wooden racetrack surface 22, thereby to provide elevation above ground and structural support. Then, providing at least one motorized amusement vehicle positioned on the racetrack, the vehicle having a driver positioned for operating the vehicle. A preferred motorized amusement vehicle for carrying on this method is a go-kart, as known to those skilled in the art.

Additionally, great commercial utility for this invention is found in a method of producing revenue from land having a stormwater retention basin thereon, by constructing and operating a motorized amusement vehicle ride above the stormwater retention basin or pond 36, as shown in FIG. 5. The invention embodied in this method allows production of revenue from this otherwise unproductive parcel of land. Environmental regulations are such that stormwater retention ponds are usually required for commercial building projects, to help prevent direct discharge of pollutants into local streams and lakes. The project developer is thus faced with having to reserve part of the available land for use as the stormwater retention pond, which completely restricts the use of that land, decreasing available revenue from the property. A working installation of this invention has obtained required environmental permits and is successfully operating directly over such a stormwater retention basin, thereby creating additional income for the owner of the property. The method includes the steps of providing at least one motorized amusement vehicle positioned on a racetrack erected above the stormwater retention basin, the racetrack sufficiently elevated above ground level such that the stormwater retention basin operates substantially within design characteristics, and allowing drivers to operate the motorized amusement vehicle for a fee, thereby producing revenue. This arrangement is best illustrated in FIG. 5. This method could be potentially employed anywhere there is a stormwater retention basin on commercially zoned property and would be a particularly attractive addition to a mall or large shopping center.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An elevated wooden racetrack comprising:

a) a wooden racetrack surface comprising a plurality of floor boards and having a first and second outer periphery, said wooden racetrack surface extending along a plurality of tiers elevated above ground level and having a plurality of banked curves, each banked curve defining at least part of a circumference of an imaginary circle having a predetermined center, the first outer periphery of said banked curve positioned toward said center so as to define an inside curve periphery, and the second outer periphery of said banked curve positioned toward said circumference so as to define an outside curve periphery, each banked curve comprising a plurality of wooden slats positioned on edge along a lengthwise dimension of the wooden slat and abuttingly adjoining at least one other wooden slat of said plurality of wooden slats, the plurality of wooden slats positioned bent into shape and at a predetermined angle of inclination from said inside curve periphery to said outside curve periphery to thereby define the banked curve; and b) a racetrack support frame comprising a plurality of vertical support posts anchored on suitable land and connected to a plurality of support members positioned to effectively support said wooden racetrack surface, thereby to provide elevation above ground and structural support.

2. The racetrack of claim 1 further comprising at least one motorized amusement vehicle on said wooden racetrack surface.

3. The racetrack of claim 1, further including a shock absorbing guard rail positioned along at least one outer periphery of said wooden racetrack surface, thereby to absorb the shock of an impact produced by said motorized amusement vehicles.

4. The racetrack of claim 3, wherein said shock absorbing guard rail further comprises aircraft tires, thereby to provide increased shock absorption capacity.

5. The racetrack of claim 1, further comprising a safety fence positioned along said first and said second outer periphery of said wooden racetrack surface, thereby to prevent the motorized amusement vehicles from accidentally leaving the wooden racetrack surface.

6. The racetrack of claim 5, wherein said safety fence further comprises a plurality of safety wires connected to said vertical support posts and positioned along the first and second outer peripheries of the wooden racetrack surface.

7. The racetrack of claim 1, wherein said wooden racetrack surface further includes at least one arched bridge section positioned to form an overpass above at least a portion of said wooden racetrack surface, thereby to provide further variety of elevation for said surface.

8. The racetrack of claim 1, wherein said racetrack support frame further includes at least one laminated support beam comprising a plurality of wooden boards connected to each other so as to form said laminated support beam, said laminated support beam positioned connected to and underlying said wooden racetrack surface, thereby to provide very strong structural support.

9. The racetrack of claim 1, wherein at least one of said plurality of banked curve surfaces is banked at an angle selected from approximately 10 to 45 degrees.

10. The racetrack of claim 1, wherein said suitable land is selected from land having thereon a stormwater retention basin, a pond, a lake, and a wetland.

11. The racetrack of claim 1, wherein at least a portion of said wooden racetrack surface further comprises at least one layer of wood positioned between the plurality of floor boards and the plurality of support beams and braces, to thereby add structural strength.

12. A method for operating motorized amusement vehicles comprising the steps of:

a) constructing a wooden racetrack surface having a first and second outer periphery, said wooden racetrack surface extending along a plurality of tiers elevated above ground level and having a plurality of banked curves, each banked curve defining at least part of a circumference of an imaginary circle having a predetermined center, the first outer periphery of said banked curve positioned toward said center so as to define an inside curve periphery, and the second outer periphery of said banked curve positioned toward said circumference so as to define an outside curve periphery, each banked curve comprising a plurality of wooden slats positioned vertically on edge and abuttingly adjoining at least one other wooden slat of said plurality, the plurality of wooden slats positioned bent into shape and at a predetermined angle of inclination from said inside curve periphery to said outside curve periphery, thereby to define the banked curve, said wooden racetrack surface for racing motorized amusement vehicles thereon;

b) supporting the racetrack surface on a support frame comprising a plurality of vertical support posts anchored on suitable land and connected to a plurality of support beams and support braces, said support beams and support braces positioned abuttingly underlying and connected to said wooden racetrack surface, thereby to provide elevation above ground and structural support; and c) operating at least one motorized amusement vehicle on said racetrack, said vehicle having a driver for operating said vehicle.

13. The method of claim 12 wherein the at least one motorized amusement vehicle comprises a go-kart.

14. The method of claim 12, further comprising constructing a shock absorbing guard rail along at least one outer periphery of said wooden racetrack surface to thereby absorb the shock of an impact produced by said at least one motorized amusement vehicle.

15. The method of claim 14 wherein the shock absorbing guard rail further comprises aircraft tires to provide increased shock absorption capacity.

16. The method of claim 12, further comprising constructing a safety fence along the first and second outer peripheries of the wooden racetrack surface to help prevent the at least one motorized amusement vehicle from accidentally leaving the wooden racetrack surface.

17. The method of claim 16, wherein constructing further comprises adding to the safety fence a plurality of safety wires connected to the vertical support posts and positioned along the first and second outer peripheries of the wooden racetrack surface.

18. The method of claim 12, further comprising constructing at least one arched bridge section positioned to form an overpass above at least a portion of the wooden racetrack surface to provide further variety of elevation.

19. The method of claim 12, further comprising constructing at least one laminated support beam comprising a plurality of wooden boards connected to each other underlying the wooden racetrack surface to provide structural support.

20. The method of claim 12, further comprising constructing at least one of the plurality of banked curves at an angle selected from approximately 10 to 45 degrees.

21. The method of claim 12, wherein supporting comprises suitable land selected from land having thereon a stormwater retention basin, a pond, a lake, and a wetland.

22. The method of claim 12, further comprising constructing the wooden racetrack surface having at least one layer of wood positioned between the plurality of floor boards and the plurality of support beams and braces to add structural strength.

* * * * *